US005937778A

United States Patent [19]

McCabe

[11] Patent Number: 5,937,778

[45] Date of Patent: Aug. 17, 1999

[54] SAIL

[76] Inventor: Francis J. McCabe, #6 Bunker Hill Rd., Ottsville, Pa. 18942

[21] Appl. No.: 09/181,113

[22] Filed: Oct. 28, 1998

[51] Int. Cl.[6] ..... B63H 9/04

[52] U.S. Cl. ..... 114/102.13; 114/39.31

[58] Field of Search ..... 114/102.1, 102.13, 114/102.14, 102.22, 39.1, 39.21, 39.3, 39.31; 416/237

[56] References Cited

U.S. PATENT DOCUMENTS 3,934,533 1/1976 Wainwright ..... 114/102.22

4,402,277 9/1983 Wainwright ..... 114/102.22

4,655,122 4/1987 McCabe ..... 98/119

5,599,172 2/1997 McCabe ..... 417/334

5,711,653 1/1998 McCabe ..... 416/237

*Primary Examiner*—Jesus D. Sotelo

*Attorney, Agent, or Firm*—Frank J. Benasutti

[57] ABSTRACT

A sail has a main sheet mounted to a mast; a leading vane on the other side of said mast from said main sheet and pivotally connected thereto; a trailing vane attached to the longitudinal edge of said main sheet remote from said mast; and an angled dual-lip member pivotally attached to the trailing edge of said trailing vane.

1 Claim, 5 Drawing Sheets

SAIL

TECHNICAL FIELD

This invention relates to improvements in sails for sail boats, and more particularly, to the aerodynamic shape of a sail having improved characteristics.

BACKGROUND ART

In the prior art, a wide variety of shapes have been used to harness the power of air in sails for vessels. Further, it has been suggested to use airfoils mounted vertically as the sail means.

In my prior art U.S. Pat. No. 4,655,122, I disclosed an improved aerodynamic shape which comprised essentially a planar face portion and leading and trailing edge portions associated with opposite ends of the face portion to form a pan-shaped enclosure. These shapes were used as blades in an air damper; where one or more blades were pivoted for rotation within a frame. In that environment, the blades provided an increased lift when forced to open by air escaping from a structure.

In my work with windmills, I experimented with various shaped blades, such as that disclosed in my U.S. Pat. No. 5,599,172 for a wind energy conversion system; which had an additional lip on the trailing edge.

In my U.S. Pat. No. 5,711,653, I disclosed an airfoil design with a 90° flange depending from the trailing edge. This displayed improved lift characteristics.

Sails, however, develop their own unique problems unrelated to environments where airfoils are normally used; such as, in particular, the fact that the sails flop back and forth from port to starboard and back again, depending on the direction of the wind. Thus, each side of the sail is acted upon in a different manner rather than being constantly impinged upon in a uniform manner.

DISCLOSURE OF THE INVENTION

SUMMARY OF THE INVENTION

I have invented a new sail which, in its simplest form, comprises a main sheet, a leading portion, a trailing portion, and a dual-flanged portion extending from the trailing portion, which dual-flange portion is preferably pivoted thereto, so as to flip back and forth from port to starboard and starboard to port side; most preferably, automatically.

DESCRIPTION OF THE PREFERRED EMBODIMENTS

Figure 1:
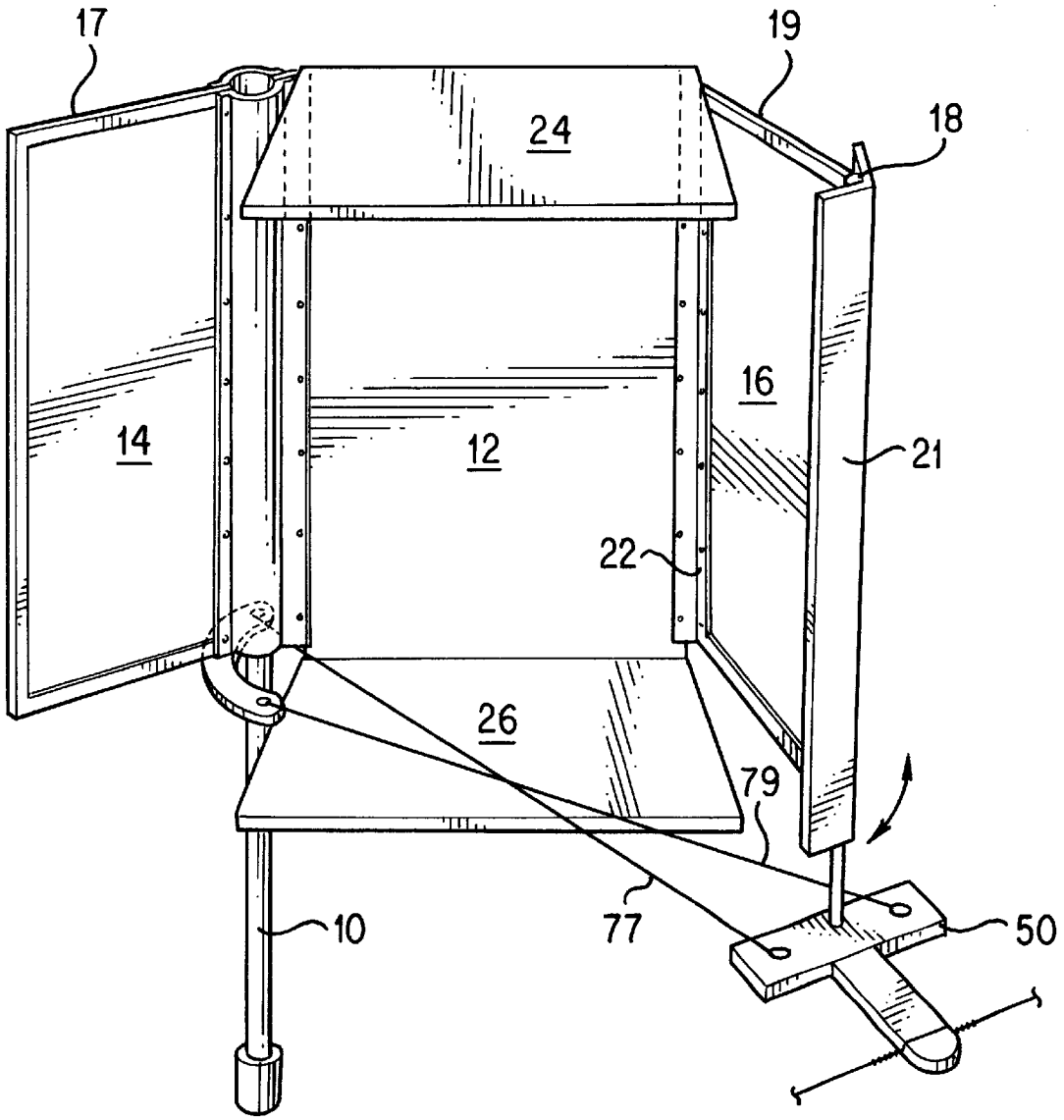
FIG. 1 is a perspective view of a sail in accordance with the preferred embodiment of my invention.

FIG. 1 shows a sail for use in a sailboat (not shown, but conventional per se) having a mast 10 and a main sheet 12 which, in this embodiment, is made most preferably of aluminum 0.020 inches thick, attached to the mast by a suitable means. A leading vane 14 is also provided attached to the mast by a suitable means.

A trailing vane 16 is provided and is attached to the main sheet 12.

The leading and trailing vanes are of fabric supported in frames 17 and 19 along their edges.

The trailing vane has a rigid angled dual-lip 21 pivotally mounted to it.

In the preferred embodiment, there is no control over the movement of the pivoted angled dual-lip, in that the wind itself will flip this angle, i.e., back and forth as indicated by the arrows in FIG. 1. Accordingly, if the wind is on the foremost side shown in FIG. 1, the angled lip would automatically be flipped outwardly to the position shown in FIG. 1A, when viewed from above. If the wind was on the other side of the sail, then the angle would be flipped to the position shown in FIGS. 1B and 1C.

Note that in 1C the main sheet 12 and trailing edge vane 16 have re-oriented themselves.

Figure 4:
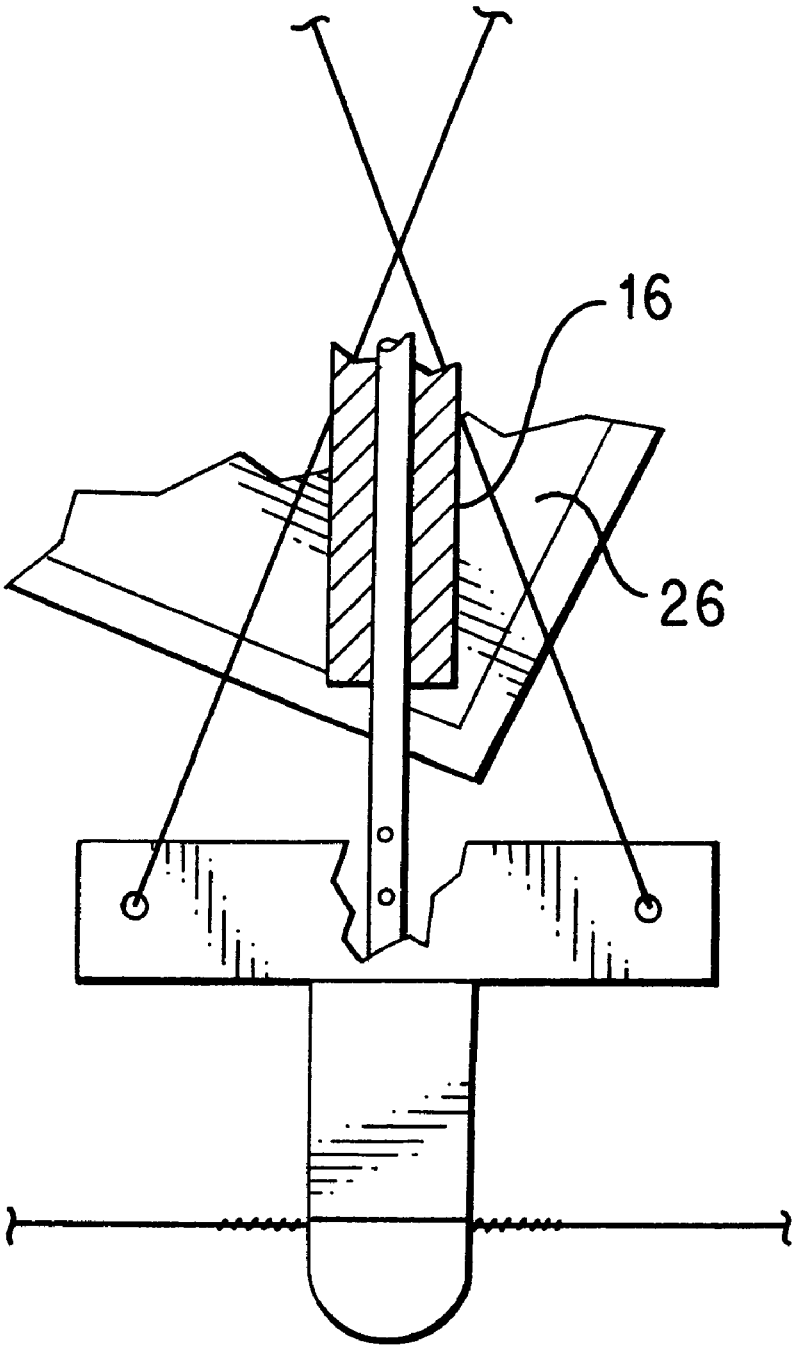
FIG. 4 is a detail of a portion of the apparatus shown in FIG. 1.

The trailing edge angled lip is connected to the frame of the member 16 as aforesaid most preferably by means of a ⅜th inch rod that rotates in the frame. This rod extends beyond the bottom portion of the frame as shown in FIG. 4 and is positioned in the T-shaped portion of the tiller bar 50 so as to rotate therein.

Figure 1A:
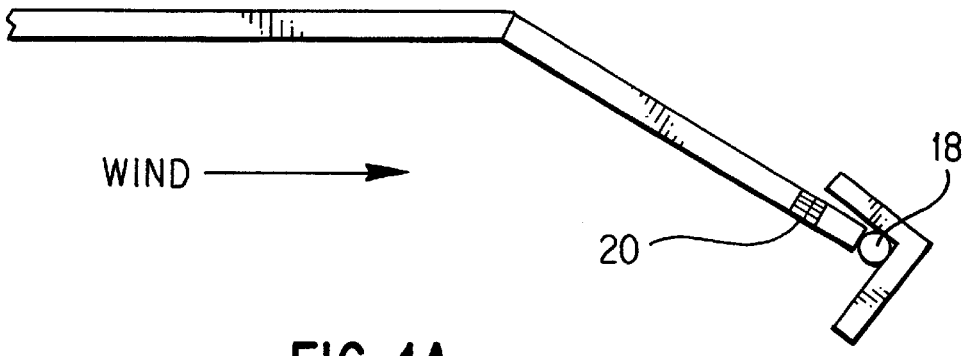
FIG. 1A is a top view of a portion of the apparatus shown in FIG. 1.
Figure 1B:
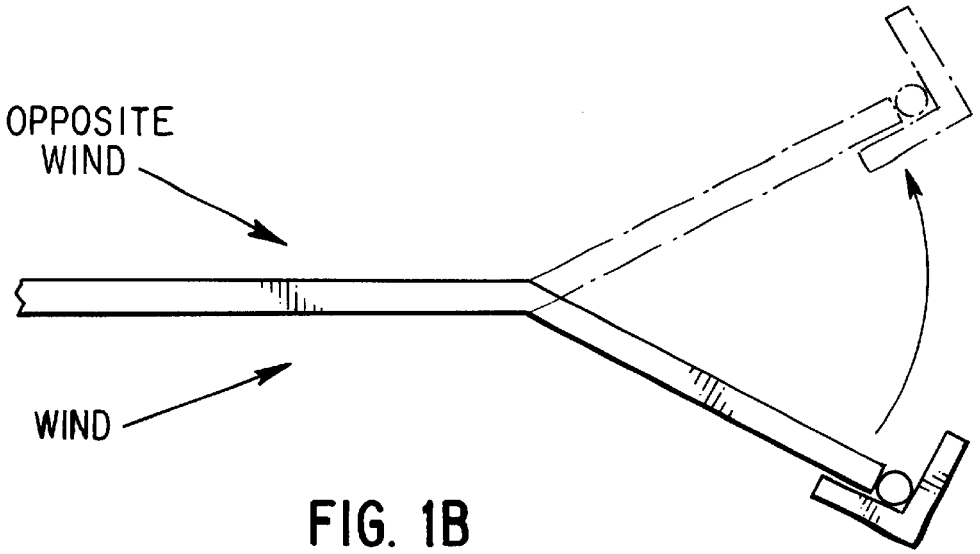
FIG. 1B is a top view similar to FIG. 1A showing a portion of the apparatus in an alternate position and a phantom portion in an alternate position.
Figure 1C:
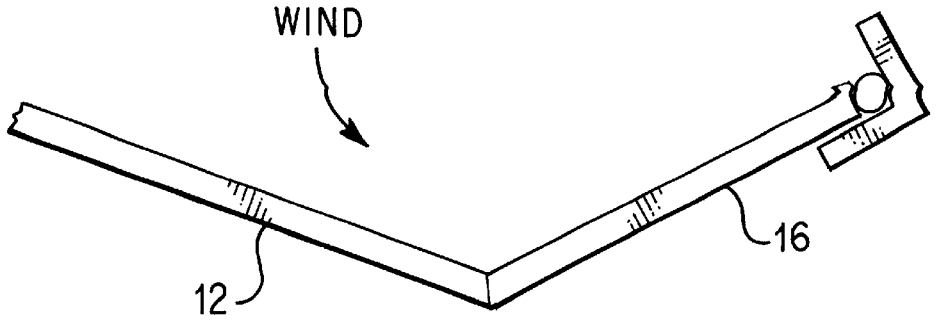
FIG. 1C is a view similar to FIG. 1B with a portion in an alternate position.

While this angled lip is pivoted by any suitable means to the trailing edge at 18, it might be suitably attached to the fabric of part 16 by, for example, a zipper 20, FIG. 1A.

Indeed, the entire fabric of part 16 may be attached by a zipper so as to be readily removable as shown at 22.

Most preferably, the sail will have top and bottom ends which are air deflectors as shown at 24, 26. These are fixedly mounted to the main section 12, but have free ends; that is, they are not fixedly attached to the members 14 or 16.

Figure 3:
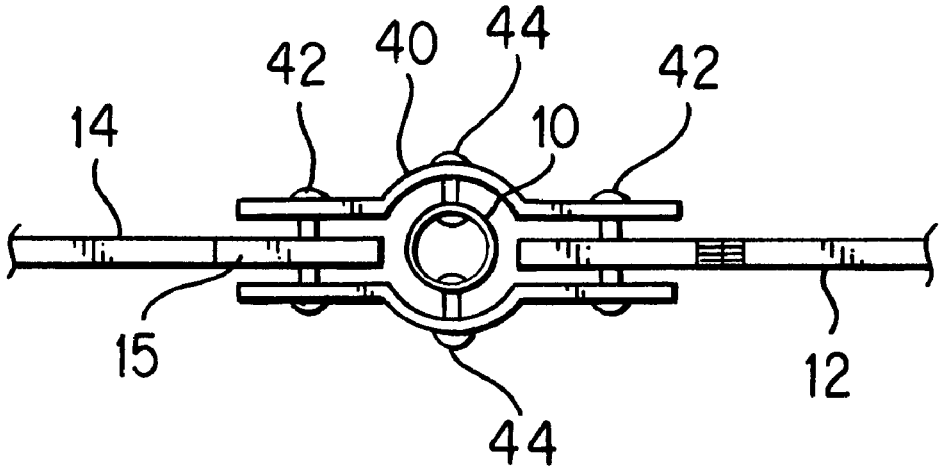
FIG. 3 is a top view of a portion of the sail shown in FIG. 1.

The means by which the leading vane 14 and main sheet 12 are connected at the mast 10 are shown in end view in greater detail in FIG. 3. Therein, it will be noted that pieces of sheathing 40 are placed around the mast on both sides and riveted to the frame 15 of the leading vane 14 on one side and the main sheet 12 on the other side as by means of rivets 42. This sheathing material 40 may be either loosely placed about the mast 10 or riveted to it as at 44.

The cloth material which forms the trailing edge vane section 16 is mounted in a frame and the frame is fixedly attached as by rivets and tape to the main sheet 12. As such, it can, and in fact does, flex back and forth to a certain degree as one side or the other of the sail fills with air. See FIGS. 1B and 1C.

Most preferably, the device is controlled by a tiller bar 50. The tiller bar is T-shaped.

On opposite ends of the horizontal portion of the T, cords 77, 79 are connected to the leading vane 14 to control its position.

The rod upon which the angled lip is mounted for rotation extends downwardly and is journaled in the horizon portion of the T-shaped tiller bar; so that the tiller bar is retained axially thereon, but it can rotate thereabout.

Figure 2:
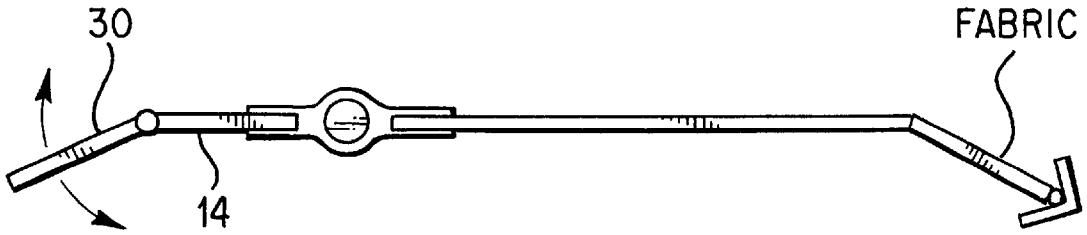
FIG. 2 is a top view of an alternate embodiment of my invention.

In an alternate embodiment shown in FIG. 2, a further vane 30 may be provided which is pivotally attached to the leading vane 14. This is a relative wind alignment vane which may be set up to either automatically or manually control the wind coming into the leading edge vane for air lift control.

Figure 5:
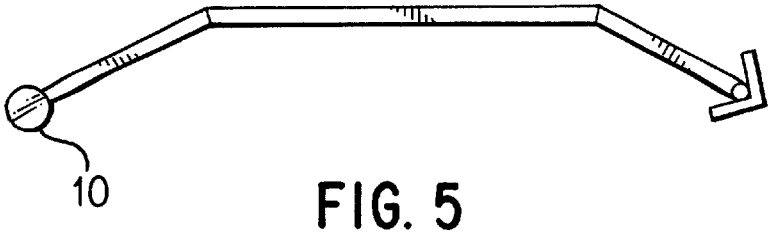
FIG. 5 is a top view of an alternative embodiment of a sail.
Figure 6:
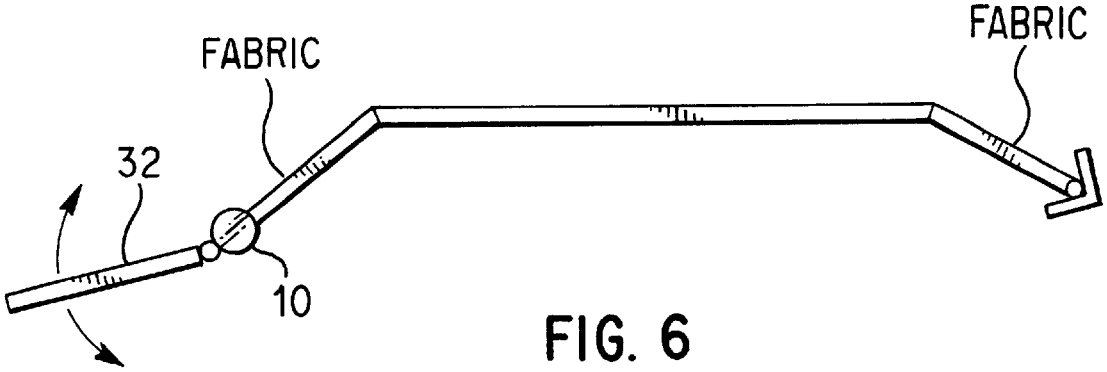
FIG. 6 is a top view of another alternative embodiment of a sail.

Other alterative embodiments are shown in FIGS. 5 and 6. In FIG. 5, the sail is attached to the mast at the outermost edge of the leading vane.

In FIG. 6, a modification of the sail arrangement, as shown in FIG. 5, is shown comprising a further vane 32 pivotally attached to the mast to serve as a relative wind alignment vane.

What is claimed is:

1. A sail comprising a main sheet mounted to a mast; a leading vane on the other side of said mast from said main sheet and pivotally connected thereto; a trailing vane attached to the longitudinal edge of said main sheet remote from said mast; and an angled dual-lip member pivotally attached to the trailing edge of said trailing vane.

* * * * *